US007281465B2

(12) United States Patent
Cochran et al.

(10) Patent No.: US 7,281,465 B2
(45) Date of Patent: Oct. 16, 2007

(54) COMPRESSOR PISTON BALL POCKET COATING

(75) Inventors: Theodore R. Cochran, Amherst, NY (US); Mingguang Zhu, E. Amherst, NY (US); Timothy M. Gabel, Tonawanda, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/327,988

(22) Filed: Jan. 9, 2006

(65) Prior Publication Data

US 2007/0157799 A1 Jul. 12, 2007

(51) Int. Cl.
*F04B 27/08* (2006.01)
*F01B 31/10* (2006.01)

(52) U.S. Cl. ..... 92/71; 92/155; 427/301

(58) Field of Classification Search ..... 92/71, 92/153, 155; 427/301
See application file for complete search history.

(56) References Cited

U.S. PATENT DOCUMENTS 5,630,355 A 5/1997 Ikeda et al.
5,655,432 A 8/1997 Wilkosz et al.
6,189,434 B1 2/2001 Kawaguchi et al.
6,283,012 B1 9/2001 Kato et al.
6,308,615 B1 * 10/2001 Takenaka et al. ..... 92/71
6,581,507 B2 * 6/2003 Mizutani et al. ..... 92/71
6,694,864 B2 2/2004 Kato et al.
6,705,207 B2 3/2004 Murase et al.
6,752,065 B2 * 6/2004 Sugioka et al. ..... 92/71
6,761,931 B1 7/2004 Cochran et al.
2001/0023636 A1 9/2001 Sugiura et al.
2002/0170425 A1 11/2002 Tarutani et al.
2003/0024380 A1 2/2003 Shimo et al.

* cited by examiner

*Primary Examiner*—Thomas E. Lazo
(74) *Attorney, Agent, or Firm*—Patrick M. Griffin

(57) ABSTRACT

The invention is applied to a compressor assembly wherein a coating is applied to the pocket in the piston for sliding engagement with a shoe for reciprocating the piston. The coating is a composite of solid particles of a lubricant, suspended in an adhesive, bonded to the to the aluminum alloy defining the pocket. More specifically, the coating comprises particles of polytetrafluoroethylene (PTFE) suspended in an epoxy resin having a low cross-linking characteristic. The particles of PTFE are sub-micron in size and the ratio of PTFE to epoxy resin is optimally one to one. The thickness of the coating is between two and ten microns and preferably substantially four microns.

13 Claims, 7 Drawing Sheets

COMPRESSOR PISTON BALL POCKET COATING

BACKGROUND OF THE INVENTION

1. Field of the Invention

A compressor assembly and method of fabricating the same wherein a coating interacts between pistons and the drive shoes that reciprocate the piston.

2. Description of the Prior Art

In a swash plate type compressor used in air conditioning systems, the rotation of the swash plate is converted to the reciprocating movement of the pistons through respective shoes. The shoe is a semi-spherical part that has a flat surface in contact with the swash plate and spherical surface in contact with a ball pocket in the piston. In response to rotation of the angled swash plate, the shoe transfers the load to the piston, which forces the piston to move reciprocally in a cylinder as the spherical surface of the shoe slides against the ball pocket surface in the associated piston. Typically, the shoe is made from hardened steel and the piston is made from an aluminum alloy. Under high-load and high-speed compressor operating conditions, the shoe transfers significant sliding wear load to the surface of the ball pocket. This high sliding wear load can deform and/or tear the relatively soft aluminum alloy surface of the ball pocket. Thus, galling or seizure at the shoe to the ball pocket interface can occur. This galling tendency can be accelerated and made more severe under a lack of lubrication condition that can result in the failure of the compressor. Therefore, a protective coating at the surface of the ball pocket is necessary to prevent galling or seizure at the shoe to ball pocket interface. In general, an ideal ball pocket coating should provide the following characteristics:

a) Conformability:—To compensate for irregularities in the surface of the ball pocket and provide a uniform contact area. This characteristic will act to reduce the wear load stress concentration.

b) Lubricity:—To provide a low coefficient of friction at the surface of the ball pocket in order to reduce wear and frictional heat generation.

c) Excellent adhesion to the substrate for extended coating life d) Durability against premature loss of function.

Traditionally, coating of the surface of the piston pocket with tin is a widely used practice for providing the four characteristics outlined above. Normally applied by an immersion process, or a chemical conversion process, the tin coating can provide for a good surface break-in and a certain degree of self-lubrication to thereby reduce the galling tendency at the surface of the piston pocket. However, the tin coating has certain limitations. First of all, the tin coating does not provide adequate protection against the galling tendencies under all circumstances. For example, under certain low lubrication condition at the shoe to pocket interface, ball pocket galling/seizure can still occur with the tin coating present. In some situations, the tin coated/plated ball pocket remains the primary failure mode of the compressor during low/no oil operation. A second limitation to the tin coating process is related to the environmental issues associated with process wastewater treatment. The separation of heavy metal from the wastewater is difficult and costly. In some manufacturing facilities, local environmental regulations prohibit the use of the tin coating process thereby requiring a remote site to apply the tin coating. This drives the need for additional inventory and work-in-process to compensate for the logistics required to use an outside or remote source, resulting in limitations in piston manufacturing process efficiency and negatively impacting total cost. In addition to this process limitation, the increase of environmental regulations globally will inevitably lead to an increased cost for wastewater treatment, and result in a more expensive tin coating process in the future.

In order to improve performance, increase productivity, reduce environmental impact and lower the piston production costs, alternative coating technology have been sought to replace the current tin coating on the ball pocket of the piston.

A polymer based solid lubricant coating is an attractive solution due to its much lower coefficient of friction as compared to the tin coating; however, the ball pocket coating requires a very thin coating layer (2-4 um), and it is difficult to apply the polymer-based coating in such a thin layer with the desired coating properties. In such a thin layer, the polymer-based coating typically does not adhere very well to the base substrate and will be worn very quickly.

SUMMARY OF THE INVENTION AND ADVANTAGES

The invention provides a coating of a composite of solid particles of a lubricant suspended in an adhesive bonded to the pocket.

The invention described is a PTFE added polymer based piston ball pocket coating that can be used to replace the current technology of tin coating. This coating is well adhered to the substrate, and is able to provide high degree of self-lubrication at the friction surface. The coating's anti-galling properties are superior to tin coating, and it is environmentally friendly because it is water based and has minimum VOC emission. Also, the coating process could be integrated into a compressor production line with the compliance of environmental regulation improving the overall efficiency of piston manufacturing, and positively impacting total cost.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE PREFERRED EMBODIMENT

Figure 1:
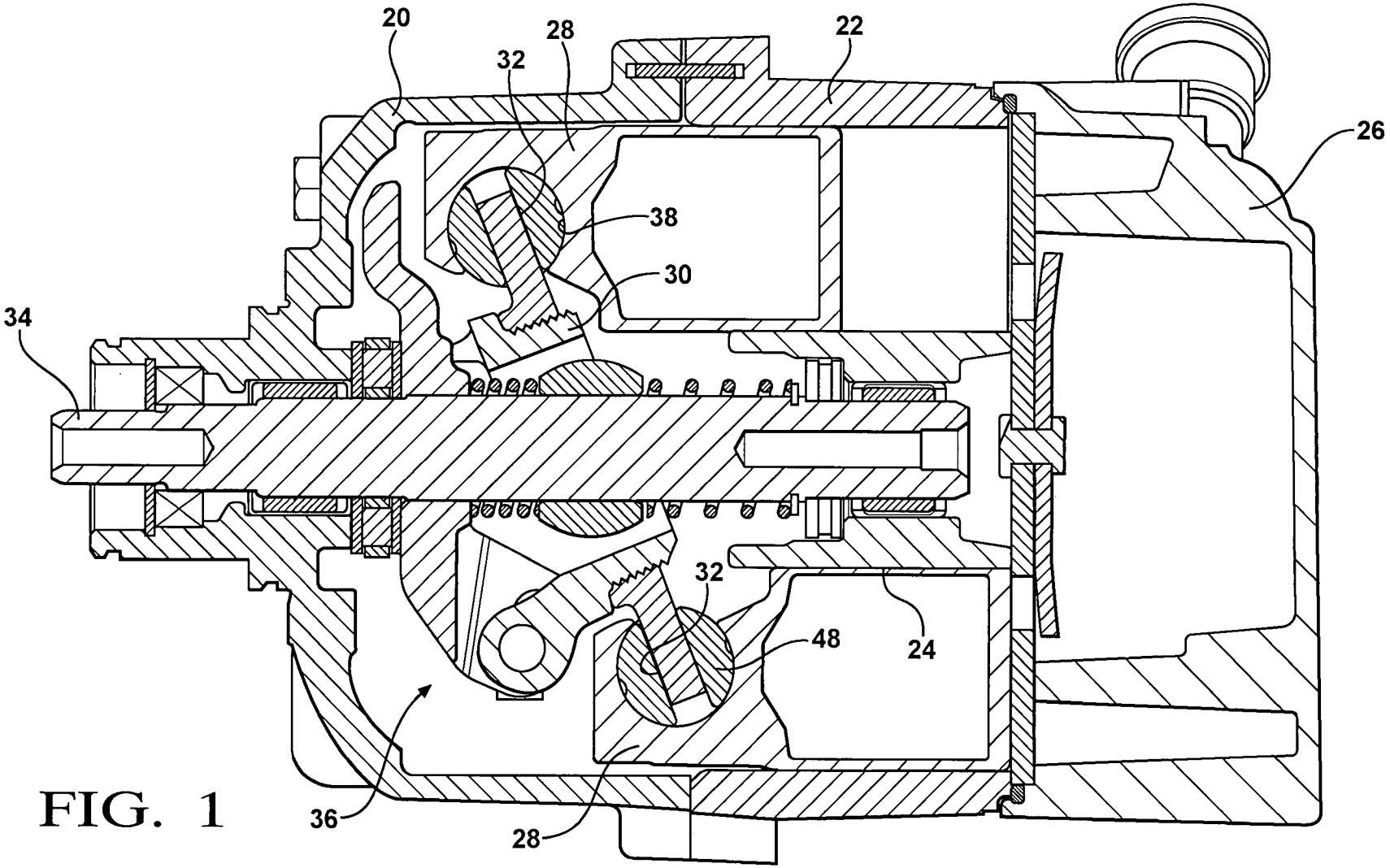
FIG. 1 is a cross sectional view of a compressor utilizing the coating of the subject invention.
Figure 2:
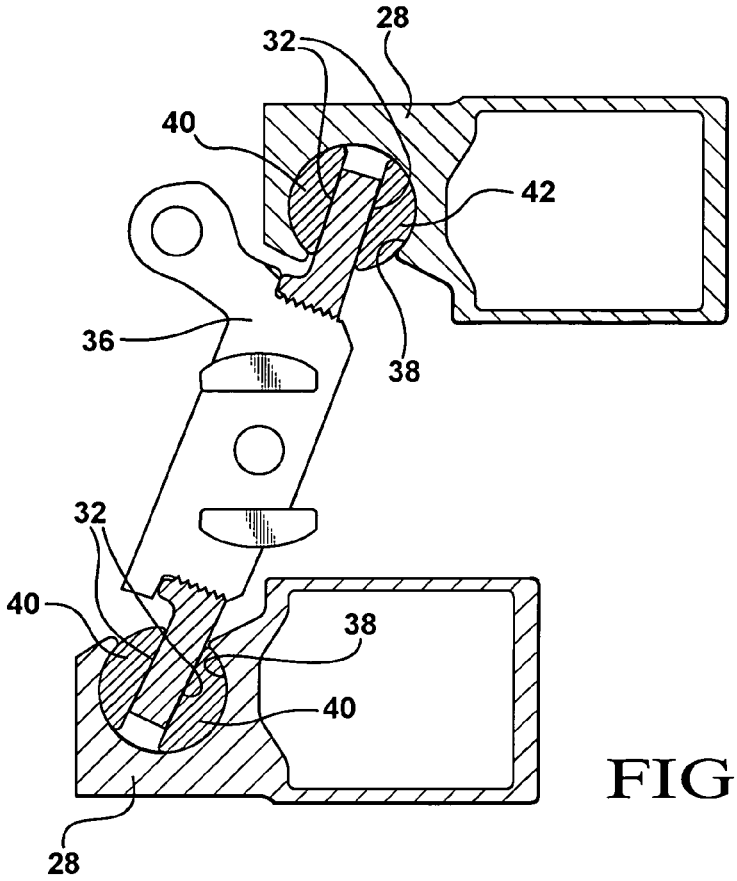
FIG. 2 is a schematic view of a compressor mechanism utilizing the coating of the subject invention.
Figure 3:
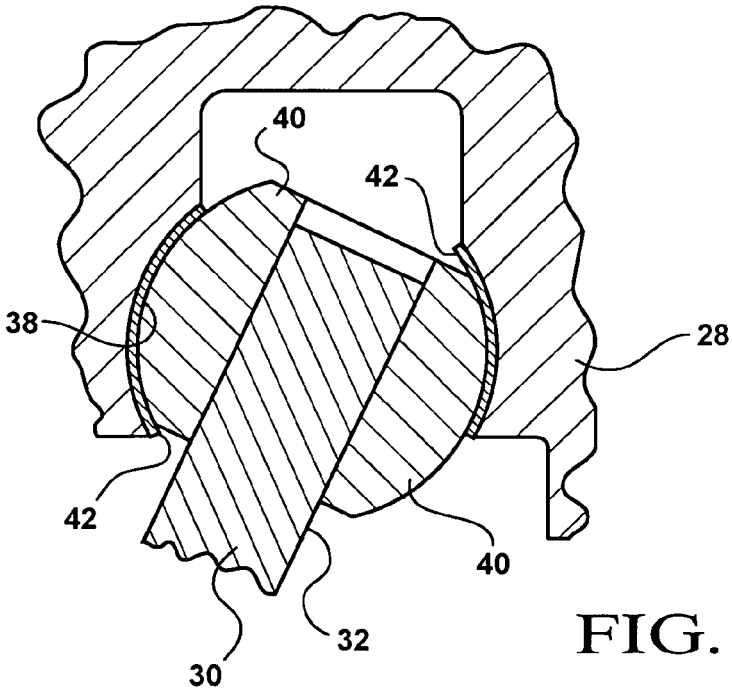
FIG. 3 is an enlarged fragmentary and cross sectional view of the coating of the subject invention disposed on the ball pocket of a piston of the compressor.

A compressor assembly with which the subject invention is utilized is generally shown in FIGS. 1, 2 and 3 typically include a housing 20 supporting a cylinder block 22 presenting a plurality of cylinder bores 24. A cap 26 closes an open end of the housing 20 and a plurality of bolts clamp the cylinder block 22 between the housing 20 and the cap 26. A piston 28 is disposed for reciprocation in each of the cylinder bores 24. The cylinder block 22 is usually an aluminum alloy.

A plate 30 presents a drive surface 32 extending transversely to the bores 24. This plate 30 is frequently referred to as a swash or wobble plate 30. A mechanism for effecting relative rotation between the cylinder block 22 and the plate 30 for reciprocating the pistons 28 in the cylinder bores 24 includes a drive shaft 34 rotatably supported by the housing 20 for rotation about an axis. The mechanism described also includes a pivot link 36 that allows the angle of the plate 30 to vary, setting the pumping capacity of the compressor.

Each of the pistons 28 includes a spherical or ball pocket 38 and the mechanism including a spherical shoe 40 on each drive surface 32 on each side of the plate 30 and in sliding engagement with the pocket 38. The shoes are usually hardened steel and a coating 42 is disposed on the surface of the pocket 38 to engage each of the shoes 40 or on the shoe to engage the pocket 38.

In accordance with the subject invention, the coating 42 is a composite of solid particles of a lubricant, suspended in an adhesive, bonded to the aluminum alloy defining the pocket 38. More specifically, the coating 42 comprises particles of polytetrafluoroethylene (PTFE) suspended in an epoxy resin having a low cross-linking characteristic. The particles of PTFE are sub-micron in size and the ratio of PTFE to epoxy resin can range from one half to one and a half to one. The thickness of the coating 42 is between two and ten microns and preferably substantially four microns.

The coating 42 material is basically a Polytetrafluoroethylene (PTFE) and epoxy resin composite. In the PTFE/epoxy composite, the PTFE particles function as a solid lubricant and the epoxy resin provides the adhesion to the base substrate and bonds the PTFE particles together.

There are many types of resin that are popular as a bonded polymer base, such as PAI and Phenolic resin. In this invention, an epoxy-based resin was selected for its excellent adhesion to metals and combined properties of strength and toughness. It was determined that by controlling the epoxy cross-linking degree, the resin base is able to obtain excellent toughness and conformability of the coating 42. This toughness and conformability acted to provide good bearing load support and lubrication of the friction surface. Also, lowering the cross-linking degree improved the conformability of the coating 42. Therefore, the wear rate of the coating 42 was reduced. Further more, the epoxy resin formula is water based and has very low VOC emission making it much more environmentally friendly than the historic tin plating/coating 42. Sub-micron sized PTFE powder is used in the coating 42 as they help the coating 42 be very precisely applied to, and uniformly distributed on, the ball pocket. The PTFE/resin weight ratio is optimized at about a one to one level but can have a range as previously stated. The high level of solid lubricant provides the high degree of lubricity of the coating 42. However, it was found that too high of PTFE content would reduce the coating 42 adhesion strength. The one to one weight ratio is the optimum level. The coating 42 also has the advantage of low curing temperature and fast curing time. With curing temperature at 350F for one to two minutes, the curing process is fast and has almost no thermal effect on base metal mechanical properties.

The spray method was used in the development. However, other application methods, such as printing, dispersion or dipping, can also been used with this coating 42.

Figure 4:
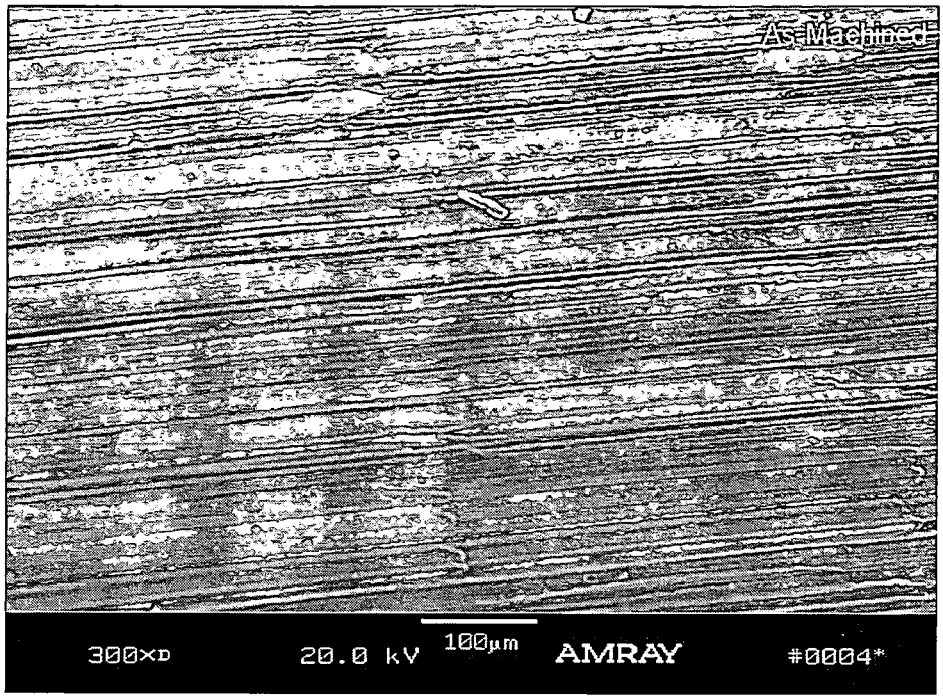
FIG. 4 is an image of the machined surface of the ball pocket.
Figure 5:
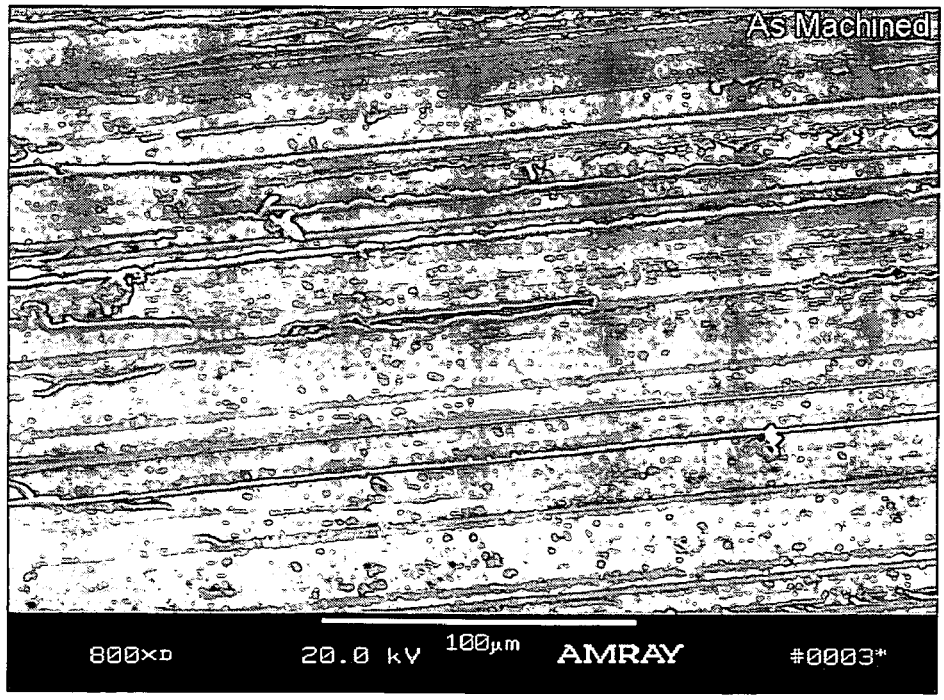
FIG. 5 is an image like FIG. 4 but at a greater magnification.

An SEM image of a typical surface texture of an as-machined ball pocket 38 surface is shown in FIG. 4 wherein the as-machined pocket 38 surface is not smooth but has relatively rough turning marks. The magnified view of the as-machined surface in FIG. 5 shows the metal flow/smear marks on the surface. The piston 28 is made from an Al—Si based alloy, which contains hard silicon particles to provide wear resistance. However, as seen in FIG. 5, the smeared aluminum has partially covered the as-machined surface. It is believed that this smeared aluminum is not optimally suited for anti-wear or anti-galling properties. Therefore, the metal surface must be treated to remove the smeared surface aluminum to expose the hard, wear resistance silicon particles in the base alloy.

A chemical polishing/etching method is used to treat the ball pocket 38 surface. Both acid and alkali based solution have the ability to polish/etch the aluminum alloy. However, the solution base and concentration must be carefully developed to have the desired reaction degree. Also, post-etch surfaces must be free of reaction product or "smut" and other contaminants. The existence of smut or other contaminants will negatively affect the coating 42 adhesion properties.

Figure 6:
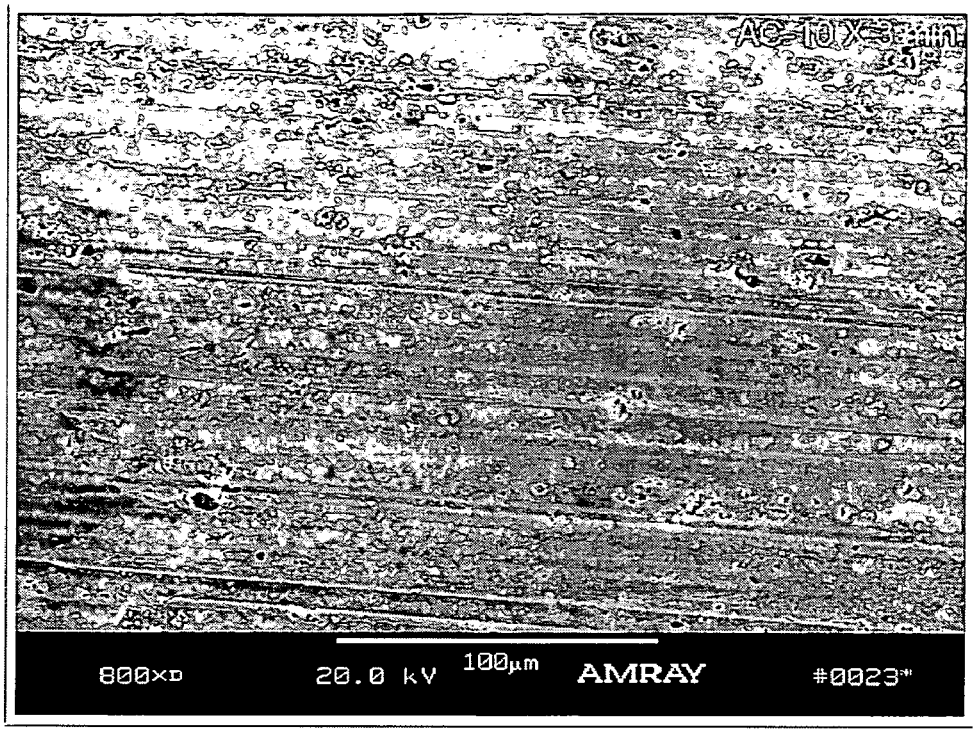
FIG. 6 is an image of the surface of the ball pocket after an acid solution treatment.
Figure 7:
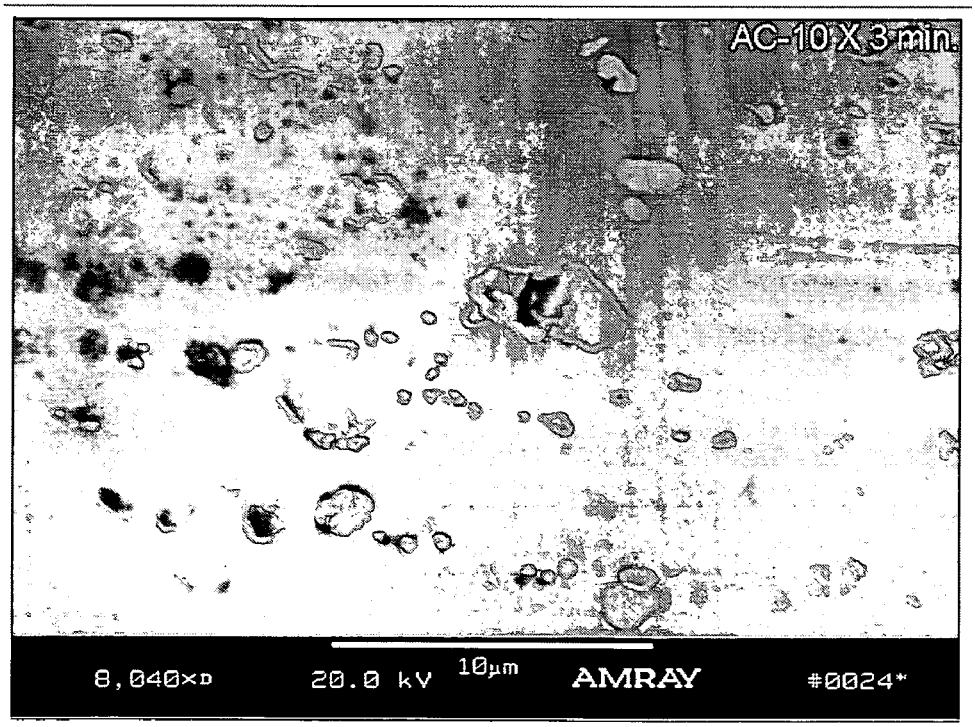
FIG. 7 is like FIG. 6 but at a greater magnification.

An HF and HNO3 acid based solution was used as the surface polishing/etching agent. It was determined that if the piston 28 was treated with a five percent (5%) solution at room temperature for two to three minutes, the surface would be well prepared for application of the coating 42. The surface texture after three minutes of treatment is shown in FIGS. 6 and 7. As compared with FIGS. 4 and 5, it is obvious that the surface turning marks are much smoother than the as-machined surface condition and the silicon particles are exposed at the surface. Also, some micro pores are generated after the etching process. These micro pores are helpful in providing mechanical interlocking sites for improving the polymer coating's 42 adhesion strength.

Accordingly, the invention provides a method of fabricating a compressor assembly of the type comprising an aluminum alloy cylinder block 22 presenting a plurality of cylinder bores 24 with a piston 28 reciprocated in each of the cylinder bores 24 as a steel spherical shoe 40 is in sliding engagement with a spherical pocket 38 in each piston 28 through a coating 42 on the pocket 38. The method includes the step of applying the coating 42 of a composite of solid particles of a lubricant suspended in an adhesive bonded to the pocket 38. The method is further defined as applying the coating 42 comprising solid particles of polytetrafluoroethylene (PTFE) suspended in an epoxy resin. Also included is the step of treating the pocket 38 with an acid based solution prior to applying the coating 42 and more particularly, treating the pocket 38 with HF and $HNO_3$ acid based solution prior to applying the coating 42. Preferably, the etching solution is applied from one to three minutes prior to applying the coating 42.

As alluded to above, the method is further defined as applying an epoxy resin having a low cross linking characteristic, applying particles of PTFE that are sub-micron in size, applying a coating 42 wherein the ratio of PTFE to epoxy resin is optimally one to one, as applying the coating 42 in a thickness between two and ten microns, preferably substantially four microns.

Since the coating 42 is water borne resin based, the VOC contents of the coating 42 formulation are very low. Therefore, the VOC related environmental issue could be minimized. The required coating 42 technology is simple and therefore suitable to integrate the coating 42 process into compressor production line.

For the chemical polishing/etching process of the pre-coating 42 surface treatment, the chemicals used are simply inorganic acids that have no heavy metal hazards involved. The wastewater can be neutralized through simple treatments. Therefore, the entire coating 42 process is environmental friendly and easily in compliance with global environmental regulations.

The following example is a typical test that shows the no-oil-dry-start test comparison of PTFE/epoxy coated ball pocket 38 verses the tin coated one. The as machined pistons 28 were dipped into five percent (5%) etching solution for two minutes and rinsed with DI water. The treated pistons 28 were then preheated to 150-200° F. and the PTFE/epoxy coating 42 was sprayed onto the ball pockets 38. The coating 42 uses submicron sized PTFE particles and has an optimized 1:1 weight ratio of PTFE/epoxy. The epoxy resin is water based with low cross-linking characteristics. The as-sprayed coating 42 thickness is about four microns. The ball pocket 38 coated pistons 28 were then cured at 350° F. for two minutes.

Figure 8:
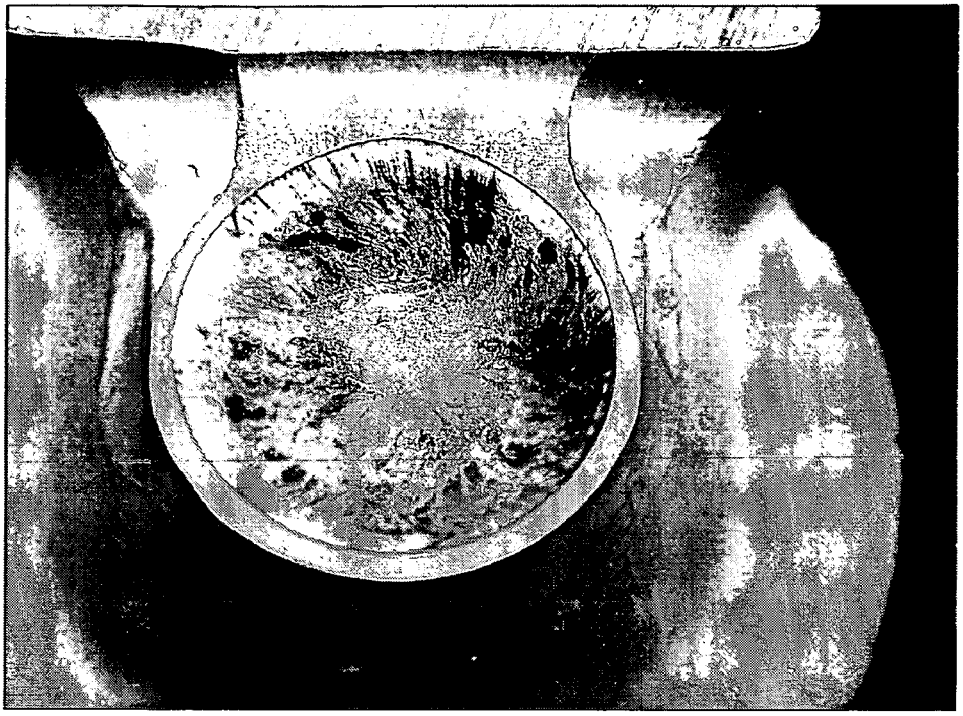
FIG. 8 is an image of a ball pocket coated with tin after a dry start.
Figure 9:
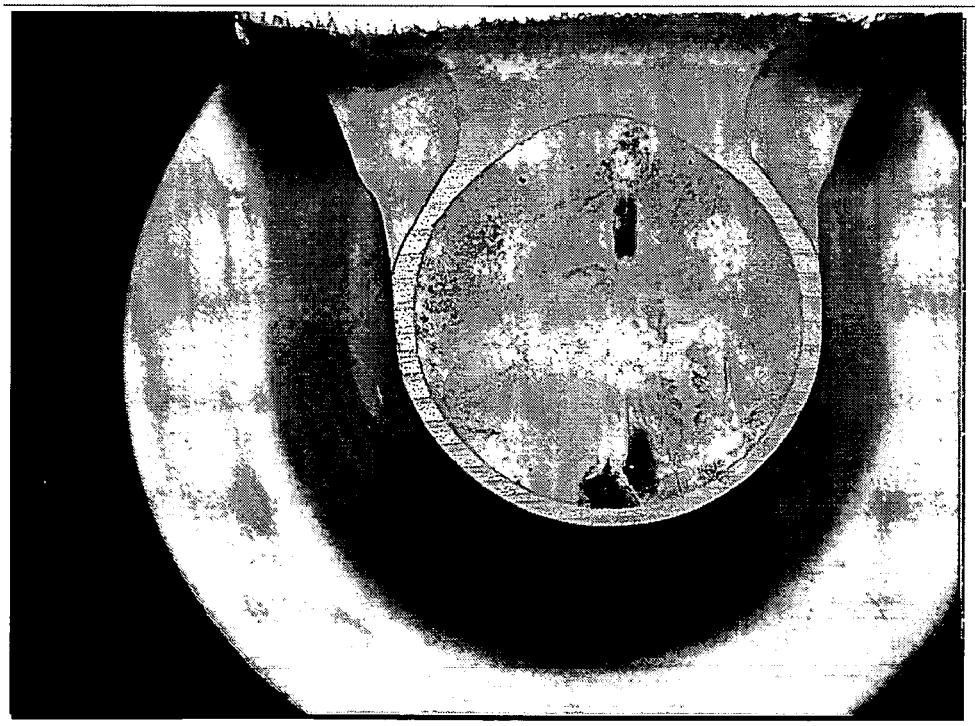
FIG. 9 is an image of a ball pocket coated with the subject invention after a dry start.

Six pistons 28 with ball pockets 38 that had been coated by PTFE/Epoxy coating 42 were installed in a seven-cylinder A/C compressor. For comparison, one of the pistons 28, with a tin coated/plated ball pocket 38 was also installed in the same compressor. By introducing two types of coated piston 28 in a same compressor, test condition variation is minimized, and the test results are directly comparable. The compressor was subjected to a no-oil-dry start test. As indicated by the test name, there is no oil in the A/C system during the test. The compressor was engaged at 1800 rpm. After fifty-four seconds, the tin coated ball pocket 38 galled, whereas all of the PTFE/Epoxy coated pockets 38 remain in good condition. FIGS. 8 and 9 show the post-test ball pocket 38 surface of tin and PTFE/epoxy coated pistons 28 respectively. It can be seen that the tin coated surface has been smeared and the aluminum alloy substrate galled. However, the PTFE/epoxy coating 42 remains in excellent condition. From FIG. 9, it can be seen that the PTFE/epoxy coating 42 is at the beginning of its wear-in stage. Most of the coating 42 is in its original condition and few high-spot areas had very smooth wear-in.

Figure 10:
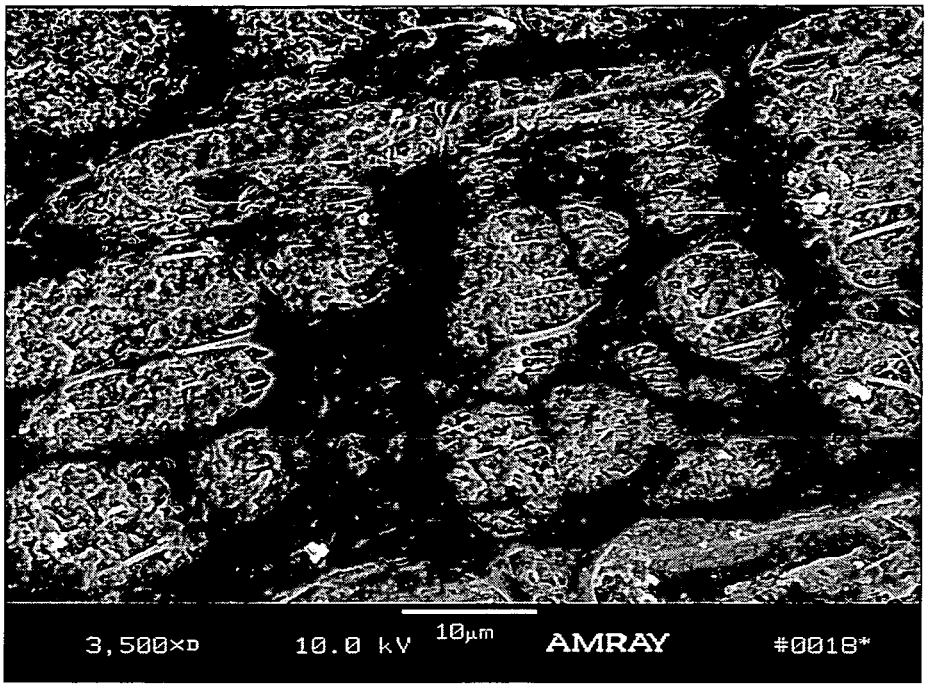
FIG. 10 is an image of a ball pocket coated with the subject invention after a dry start.
Figure 11:
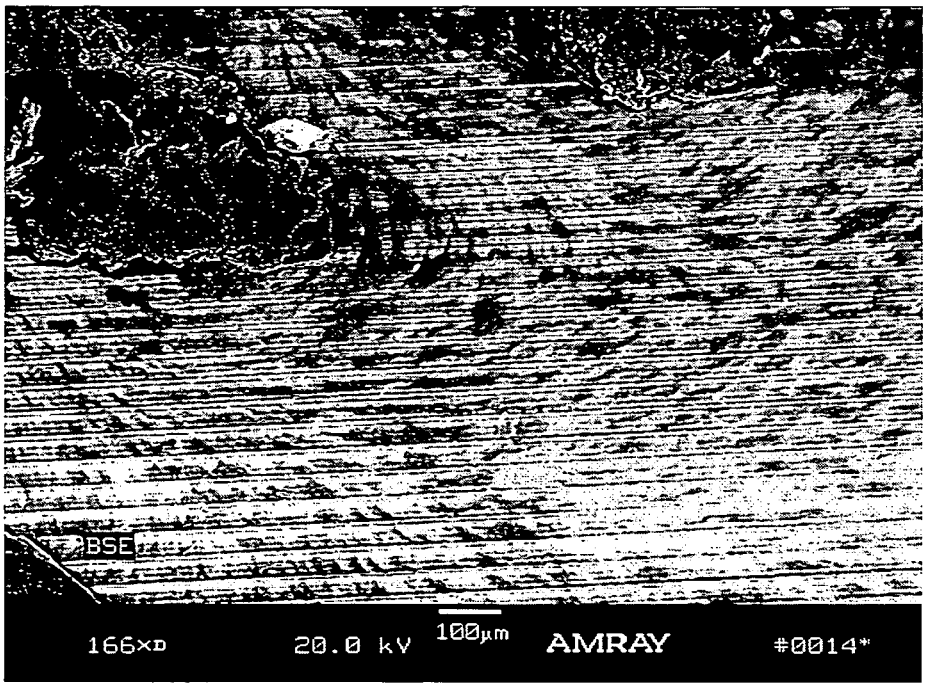
FIG. 11 is a back scatter electron image of the coating of FIG. 10.

A ball pocket 38 worn surface analysis may be accomplished by looking closely at the PTFE/epoxy coated worn area in FIG. 10, which is an SEM secondary electron image that shows the detailed coating 42 wear-in surface. FIG. 10 clearly shows that during the dry-start test, the PTFE/epoxy coatings 42 are very flexibly conformed on the rubbing/friction surface. The coating 42 was compressed and deformed but still adequately covered the metal substrate. FIG. 11 is a back scatting electron image that shows some more aggressive wear-in area. The light color areas are metal substrate and the dark color areas are remaining PFTE/epoxy coating 42. From FIG. 11, it can been seen that after the relatively aggressive wear-in from the dry start test, the coating 42 is partially damaged and deformed by the rotational movement of shoe 40 surface. Some of the coating 42 is worn away as expected. However, the discontinuous dark spots show that there is still a very thin coating 42 film adhered to the metal substrate. The existence of this thin PTFE rich film will continue to provide the self-lubrication characteristic desired from the coating 42. The uniform turning marks show that the substrate had been protected by the smeared coating 42 film.

Figure 12:
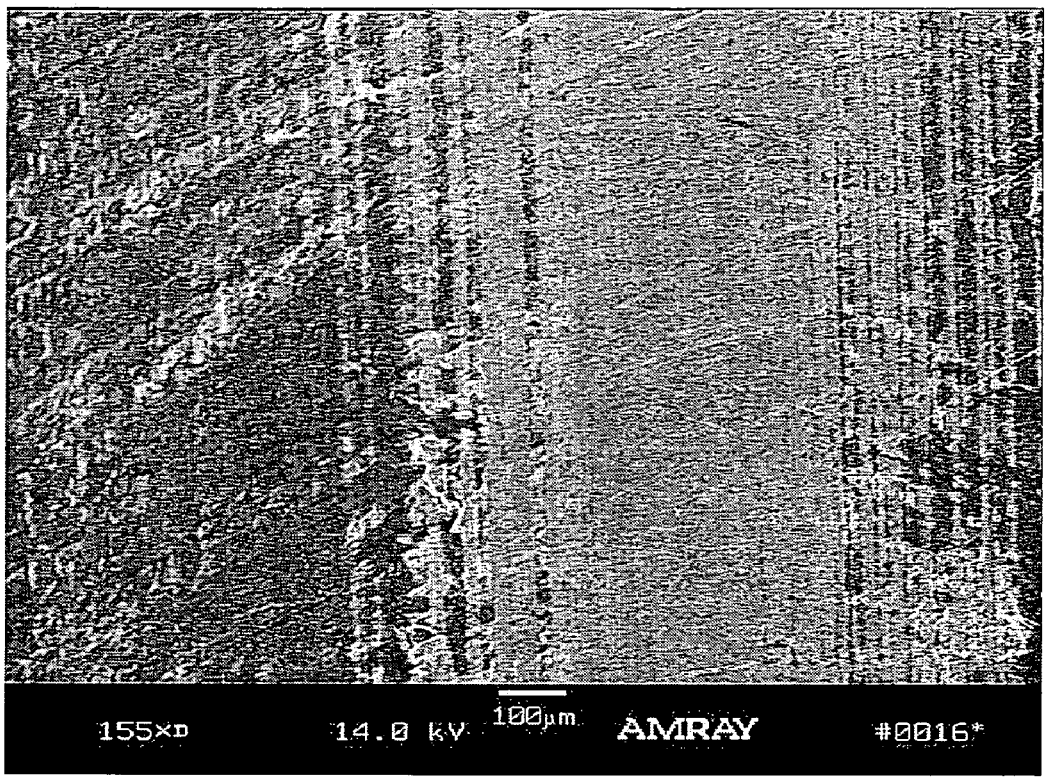
FIG. 12 is an image of a break-in area of a ball pocket coated with the subject invention

Since the ball pocket 38 is not well matched to the shoe 40, there are some areas that have higher loading than others. FIG. 12 indicates that the original tuning marks at the high load areas have been "polished" during the no oil dry start test. Clearly, the galling tendency is largely reduced by the PTFE/epoxy coating 42 in the ball pocket 38

Obviously, many modifications and variations of the present invention are possible in light of the above teachings. The invention may be practiced otherwise than as specifically described within the scope of the appended claims. For example, submicron sized solid lubricants such as MoS2, WS2 and etc. can also been introduced into this coating

What is claimed is:

1. A compressor assembly comprising;

a housing, a cylinder block presenting a plurality of cylinder bores and supported by said housing, a piston disposed for reciprocation in each of said cylinder bores, a plate presenting a drive surface extending transversely to said bores, a mechanism for effecting relative rotation between said cylinder block and said plate for reciprocating said pistons in said cylinder bores, each of said pistons including a spherical pocket, said mechanism including a spherical shoe in sliding engagement with said pocket, a coating between said pocket and said shoe, and characterized by said coating being a composite of solid particles of a lubricant suspended in an adhesive bonded to one of said pocket and said shoe;

wherein said coating comprises particles of polytetrafluoroethylene (PTFE) suspended in an epoxy resin;

wherein said cylinder is an aluminum alloy; and wherein said epoxy resin has a low cross-linking characteristic.

2. An assembly as set forth in claim 1 wherein the thickness of said coating is between two and ten microns.

3. An assembly as set forth in claim 1 wherein the thickness of said coating is substantially four microns.

4. A compressor assembly comprising:

a housing, a cylinder block presenting a plurality of cylinder bores and supported by said housing, a piston disposed for reciprocation in each of said cylinder bores, a plate presenting a drive surface extending transversely to said bores, a mechanism for effecting relative rotation between said cylinder block and said plate for reciprocating said pistons in said cylinder bores, each of said pistons including a spherical pocket, said mechanism including a spherical shoe in sliding engagement with said pocket, a coating between said pocket and said shoe, and characterized by said coating being a composite of solid particles of a lubricant suspended in an adhesive bonded to one of said pocket and said shoe;

wherein said coating comprises particles of polytetrafluoroethylene (PTFE) suspended in an epoxy resin;

wherein said cylinder is an aluminum alloy; and wherein said particles of PTFE are sub-micron in size.

5. A compressor assembly comprising:

a housing, a cylinder block presenting a plurality of cylinder bores and supported by said housing, a piston disposed for reciprocation in each of said cylinder bores, a plate presenting a drive surface extending transversely to said bores, a mechanism for effecting relative rotation between said cylinder block and said plate for reciprocating said pistons in said cylinder bores, each of said pistons including a spherical pocket, said mechanism including a spherical shoe in sliding engagement with said pocket, a coating between said pocket and said shoe, and characterized by said coating being a composite of solid particles of a lubricant suspended in an adhesive bonded to one of said pocket and said shoe;

wherein said coating comprises particles of polytetrafluoroethylene (PTFE) suspended in an epoxy resin;

wherein said cylinder is an aluminum alloy; and wherein the weight ratio of PTFE to epoxy resin is in the range from 0.5 PTFE to 1.0 epoxy resin to 1.5 PTFE to 1.0 epoxy resin.

6. A compressor assembly comprising:

a housing, a cylinder block presenting a plurality of cylinder bores and supported by said housing, a piston disposed for reciprocation in each of said cylinder bores, a plate presenting a drive surface extending transversely to said bores, a mechanism for effecting relative rotation between said cylinder block and said plate for reciprocating said pistons in said cylinder bores, each of said pistons including a spherical pocket, said mechanism including a spherical shoe in sliding engagement with said pocket, a coating between said pocket and said shoe, and characterized by said coating being a composite of solid particles of a lubricant suspended in an adhesive bonded to one of said pocket and said shoe;

wherein said piston is an aluminum alloy and said shoe is steel, and said coating includes particles of polytetrafluoroethylene (PTFE) suspended in an epoxy resin bonded to said aluminum alloy with the weight ratio of PTFE to epoxy resin being in the range from 0.5 PTFE to 1.0 epoxy resin to 1.5 PTFE to 1.0 epoxy resin.

7. An assembly as set forth in claim 6 wherein the thickness of said coating is being between two and ten microns.

8. A method of fabricating a compressor assembly of the type comprising a cylinder block presenting a plurality of cylinder bores with a piston reciprocated in each of the cylinder bores as a spherical shoe is in sliding engagement with a spherical pocket in each piston through a coating on the surface of one of the pocket and the shoe, said method characterized by the steps of;

applying the coating of a composite of solid particles of a lubricant suspended in an adhesive bonded to one of the pocket and the shoe;

applying the coating comprising solid particles of polytetrafluoroethylene (PTFE) suspended in an epoxy resin; and treating the surface with an acid based solution prior to applying the coating.

9. A method of fabricating a compressor assembly of the type comprising a cylinder block presenting a plurality of cylinder bores with a piston reciprocated in each of the cylinder bores as a spherical shoe is in sliding engagement with a spherical pocket in each piston through a coating on the surface of one of the pocket and the shoe, said method characterized by the steps of;

applying the coating of a composite of solid particles of a lubricant suspended in an adhesive bonded to one of the pocket and the shoe;

applying the coating comprising solid particles of polytetrafluoroethylene (PTFE) suspended in an epoxy resin; and treating the surface with an HF and $HNO_3$ acid based solution prior to applying the coating.

10. A method of fabricating a compressor assembly of the type comprising a cylinder block presenting a plurality of cylinder bores with a piston reciprocated in each of the cylinder bores as a spherical shoe is in sliding engagement with a spherical pocket in each piston through a coating on the surface of one of the pocket and the shoe, said method characterized by the steps of;

applying the coating of a composite of solid particles of a lubricant suspended in an adhesive bonded to one of the pocket and the shoe;

applying the coating comprising solid particles of polytetrafluoroethylene (PTFE) suspended in an epoxy resin; and treating the surface with five percent of an HF and $HNO_3$ acid based solution for one to three minutes prior to applying the coating.

11. A method of fabricating a compressor assembly of the type comprising a cylinder block presenting a plurality of cylinder bores with a piston reciprocated in each of the cylinder bores as a spherical shoe is in sliding engagement with a spherical pocket in each piston through a coating on the surface of one of the pocket and the shoe, said method characterized by the steps of;

applying the coating of a composite of solid particles of a lubricant suspended in an adhesive bonded to one of the pocket and the shoe;

applying the coating comprising solid particles of polytetrafluoroethylene (PTFE) suspended in an epoxy resin;

applying the coating to a sphere of an aluminum alloy defining the pocket for sliding engagement with a shoe of steel; and applying an epoxy resin having a low cross linking characteristic.

12. A method of fabricating a compressor assembly of the type comprising a cylinder block presenting a plurality of cylinder bores with a piston reciprocated in each of the cylinder bores as a spherical shoe is in sliding engagement with a spherical pocket in each piston through a coating on the surface of one of the pocket and the shoe, said method characterized by the steps of;

applying the coating of a composite of solid particles of a lubricant suspended in an adhesive bonded to one of the pocket and the shoe;

applying the coating comprising solid particles of polytetrafluoroethylene (PTFE) suspended in an epoxy resin;

applying the coating to a sphere of an aluminum alloy defining the pocket for sliding engagement with a shoe of steel; and applying particles of PTFE that are sub-micron in size.

13. A method of fabricating a compressor assembly of the type comprising a cylinder block presenting a plurality of cylinder bores with a piston reciprocated in each of the cylinder bores as a spherical shoe is in sliding engagement with a spherical pocket in each piston through a coating on the surface of one of the pocket and the shoe, said method characterized by the steps of;

applying the coating of a composite of solid particles of a lubricant suspended in an adhesive bonded to one of the pocket and the shoe;

applying the coating comprising solid particles of polytetrafluoroethylene (PTFE) suspended in an epoxy resin;

applying the coating to a sphere of an aluminum alloy defining the pocket for sliding engagement with a shoe of steel; and applying a coating wherein the weight ratio of PTFE to epoxy resin is optimally one to one.

* * * * *